United States Patent [19]

Masunaga et al.

[11] 4,072,620

[45] Feb. 7, 1978

[54] ELECTRICAL INSULATING OIL

[75] Inventors: Midori Masunaga, Tokyo; Yoshiki Kohno, Kawasaki; Hiroshi Hasegawa, Yokohama, all of Japan

[73] Assignee: Nippon Oil Co., Ltd., Tokyo, Japan

[21] Appl. No.: 656,906

[22] Filed: Feb. 10, 1976

[30] Foreign Application Priority Data

Feb. 13, 1975 Japan ..... 50-17480

[51] Int. Cl.[2] ..... H01B 3/22

[52] U.S. Cl. ..... 252/63; 208/14; 208/19

[58] Field of Search ..... 208/14, 19; 252/63

[56] References Cited

U.S. PATENT DOCUMENTS

| | | | |
|---|---|---|---|
| 2,190,918 | 2/1940 | Goethel et al. | 208/19 |
| 3,657,132 | 4/1972 | Gourlaouen et al. | 252/63 |
| 3,804,743 | 4/1974 | Mills et al. | 208/14 |
| 3,925,220 | 12/1975 | Mills | 208/14 |

OTHER PUBLICATIONS

Bruins "Plasticizer Technology", vol. 1, 1965, pp. 79-80.

*Primary Examiner*—Herbert Levine
*Attorney, Agent, or Firm*—Frank J. Jordan

[57] ABSTRACT

An electrical insulating oil having excellent oxidation stability, thermal stability, corona resistance and corrosion resistance and, if desired, low-temperature properties, which consist essentially of a blend of a refined oil (I) derived from a paraffin or mixed base crude oil, a refined oil (II) prepared from a lubricating oil fraction of a mineral oil and, if desired, an amorphous ethylene-propylene copolymer (III). The oils (I) and (II) may be blended together in ratios by weight of 80 - 99 : 1 - 20. In one embodiment, the copolymer may be added to the blend of the oils (I) and (II) in ratios by weight of 0.001 - 1.0 to 100 thereby to obtain an electrical insulating oil having excellent low-temperature properties in addition to the above-mentioned excellent properties.

6 Claims, No Drawings

ELECTRICAL INSULATING OIL

This invention relates to excellent electrical insulating oils essentially derived from paraffin base crude oils or mixed base crude oils. More particularly this invention relates to an excellent electrical insulating oil consisting essentially of (A) 80 - 99 parts by weight of a refined oil(I) containing not more than 0.25 wt.% of sulphur and more than 25 wt.% to not more than 35 wt.% of aromatic compounds, the refined oil being prepared by refining with a solvent a distillate contained in a fraction having a boiling range of 230° - 430° C at atmospheric pressure obtained by distilling a paraffin or mixed base crude oil at atmospheric pressure or distilling at a reduced pressure a bottom oil obtained by the distillation of the crude oil at atmospheric pressure, thereby to obtain a raffinate which is then hydrofined, dewaxed with a solvent and, if desired, treated with a solid adsorbent thus obtaining the refined oil (I) and (B) 1 - 20 parts by weight of a refined oil (II) prepared by treating a lubricating oil fraction of a mineral oil at least with a solid adsorbent, to obtain the electrical insulating oil having a total sulphur content of not more than 0.35 wt.% as well as excellent oxidation stability, thermal stability, corona resistance and corrosion resistance; this invention relates also to an excellent electrical insulating oil prepared by incorporating said electrical insulating oil as a base oil with 0.001 - 1.0 part by weight per 100 parts by weight of said base oil, of an essentially amorphous ethylene-propylene copolymer (III) having a weight average molecular weight of 10,000 - 200,000 and a propylene content of 10 - 70 mol%, whereby is obtained the electrical insulating oil having a sufficiently low pour point in addition to the excellent properties exhibited by said insulating oil consisting essentially of the oils (I) and (II).

Various insulating oils have heretofore been marketed, and the quantitatively greater part thereof has been of a mineral oil type. The reason for this is that as compared with insulating oils obtained by synthesis, mineral oil type insulating oils may be supplied at a relatively low cost and in large amounts since they are prepared from petroleum fractions as the principal starting material therefor. The synthetic insulating oil have partly been limited in certain particular uses.

On the other hand, the conventional mineral oil type insulating oils are not such that all of them may be produced from any crude oils without substantial difference in quality therebetween as is the case with gasoline or kerosene. In practice, in order to produce a mineral oil type insulating oil, it is the most important to select a crude oil for the insulating oil; more particularly, there have practically been needed, as the crude oils naphthene base crude oils which have a certain range of specific gravity, flash point and viscosity as well as a low freezing point and a low sulphur content.

Even if such naphthene base crude oils are distilled in attempts to obtain a fraction which is, per se, suitable as an electrical insulating oil, it will be impossible to obtain such a fraction.

Typical processes which have heretofore been known as those for the preparation of electrical insulating oils from naphthene base crude oils, are described hereinbelow.

One known process is one for the preparation of insulating oils by effecting a treatment with sulphuric acid in a specific manner (Japanese Patent Gazette No. 10133/61); however, that process is disadvantageous in that the disposal of used sulphuric acid produced as waste therein causes environmental pollution and the yield of product obtained is low thereby rendering that process unsuitable for industrial use.

Another known process is one for the preparation of insulating oils by hydrofining a mineral oil to the extent that 65 - 96% of the sulphur content thereof has been desulphurized or by mixing the thus hydrofined mineral oil with a mineral oil containing lower aromatic compounds; however, it is seen from the following publication that products to be obtained will be greatly degraded in oxidation stability if the mineral oil is otherwise treated with a solvent prior to the hydrofining for desulphurization (Japanese Patent Gazette No. 18584/61).

Still another known process is one which comprises hydrofining a lubricating oil fraction without being treated with a solvent as in the preceding process to the extent that at least 95% of the sulphur content of said fraction and then adding a mineral oil treated with sulphuric acid to the thus hydrofined lubricating oil fraction (Japanese Laying-Open Patent Gazette No. 46199/74).

A further known process is one which comprises hydrogenating a lubricating oil raffinate containing not more than 23wt.% of aromatic compounds and then adding to the thus hydrogenated raffinate not more than 15wt.% of a lubricating oil containing larger amounts of aromatic compounds (Japanese Patent Gazette No. 3589/66).

As mentioned above, each of these known processes using naphthene base crude oils as the starting materials, per se, discloses a specific process for the preparation of an electrical insulating oil. Since, however, these naphthene base crude oils have been extremely difficult to obtain since the recent petroleum panic, it has been desired to obtain electrical insulating oils from mixed or paraffin base crude oils which are available at a relatively low cost and in large amounts. Even if, on the other hand, it is attempted to obtain insulating oils from the mixed or paraffin base crude oils by the use of the same process as the usual one for the preparation of insulating oils from the naphthene base crude oils, there will not be obtained insulating oils having satisfactory oxidation stability, hydrogen gas absorbency, corona resistance, pour point and like properties. Therefore, it is necessary to employ a specific different process to obtain insulating oils having such satisfactory properties.

In addition, there has recently been disclosed a process for the preparation of insulating oils having a low pour point from paraffin base crude oils (Japanese Patent Gazette No. 46123/74); however, this known process uses a refined oil containing aromatic compounds in amounts of about 14% at most and may give the insulating oils by the addition of an antioxidant to base oils therefor.

Unlike these known processes, the process according to the present invention uses paraffin base crude oils which are available in relatively large amounts, in the preparation of the new electrical insulating oils therefrom.

The present inventors had made intensive studies in attempt to clarify how or under what conditions paraffin or mixed base crude oils should be treated to produce therefrom electrical insulating oils having, as their principal properties, oxidation stability, thermal stability, corona resistance, corrosion resistance and low-temperature properties in addition to, as a matter of course, satisfactory electrical properties, these properties being among those required in electrical insulating oils; and, as a result, they have found a reliable process for preparing excellent electrical insulating oils having predetermined properties.

This invention will be further detailed hereinbelow.

First of all, the refined oil (I) contained in the insulating oil of this invention as one of the essential components thereof will be explained hereunder.

The paraffin base crude oil used herein is one containing paraffinic hydrocarbons in large proportions and more particularly the crude oil is such that its first key fraction (kerosene fraction) has an API specific gravity of not smaller than 40° and its second key fraction (lubricating oil fraction boiling at 275° - 300° C at a reduced pressure of 40mm of mercury) has an API specific gravity of not smaller than 30° as is described in "Sekiyu Binran (handbook on Petroleum)" on page 19, 1972 edition, published by Sekiyu Shunju Co., Ltd., Japan; Typical of the paraffin base crude oils are a Pennsylvania crude oil, a Minas crude oil and the like.

The mixed base crude oil used herein is one which is qualitatively intermediate between the paraffin and a naphthene base crude oil and more particularly the mixed base crude oil is such that its key fraction has an API specific gravity of 33° - 40° and its second key fraction an API specific gravity of 20° - 30°. Typical of the mixed base crude oils are many of Middle East-produced crude oils such as Midcontinent, Arabia and Khafji crude oils. In this invention there may preferably be used the Arabia crude oils such as Arabian medium and Arabian light crude oils.

The mineral oil from which the refined oil (I) is prepared is a distillate contained in a fraction having a boiling range of 230° - 430° C at atmospheric pressure, the fraction being obtained by distilling a paraffin or mixed base crude oil at atmospheric pressure or by distilling at a reduced pressure a bottom oil obtained by the distillation of the crude oil at atmospheric pressure. The distillate for preparing the refined oil (I) therefrom is contained in the fraction boiling at 230° - 430° C in the amounts of at least about 80 wt.%, preferably at least about 90 wt.%.

The starting mineral oil (derived from the paraffin or mixed base crude oil) for the refined oil (I) is treated with a solvent capable of selective dissolution of aromatic compounds to decrease the amounts of sulphur and other impurities contained in the starting oil. In this case, it is a matter of course that the aromatic compounds in the starting mineral oil also decrease in amount.

The solvents for selectively dissolving the aromatic compounds are usual ones illustrated by furfural, liquefied sulphur dioxide, phenol and the like. When furfural, for example, is used as the solvent, the extracting temperatures used may be in the range of 50° - 100° C, preferably 60° - 90° C, and the ratios by volume of furfural to the starting mineral oil may be in the range of 0.3 - 2.0, preferably 0.5 - 1.5.

Then the raffinate obtained by the refinement with the solvent is hydrofined and thereafter dewaxed with a suitable solvent to obtain a predetermined pour point on the raffinate so treated. The thus treated raffinate is consecutively treated with clay as required, thereby obtaining the refined oil (I).

The respective operational conditions under which particularly the solvent refining and hydrofining treatments of all the treatments mentioned above are effected, should be determined in combination so that the refined oil (I) to be obtained contains not more than 0.25% by weight of sulphur and from more than 25% to not more than 35% by weight of aromatic compounds (The content of aromatic compounds expressed herein is intended to mean one in % which is determined by percolating a mineral oil through silica gel). In other words, it is possible to allow the operational condition of each of the solvent treatment and the hydrofining treatment to be widely varied for the purpose of obtaining the refined oil (I) since these operational conditions may be determined in combination with, not independently of, each other for the attainment of said purpose.

The limitation of the refined oil (I) to not more than 0.25 wt.% in sulphur content is based on a consideration that the resulting electrical insulating oil containing the refined oil (I) having such a sulphur content will not have adverse effects "copper blackening" in transformers which has recently raised a problem. More particularly the present inventors, as a result of their studies on the relationship between the copper blackening and sulphur content, have found that if an electrical insulating oil used contains not more than 0.35 wt.% of sulphur then the amount of sulphur to be deposited on a copper plate employed as the electrode will remarkably decreased. In the practice of this invention, therefore, the refined oil (I) should be limited to as low as not more than 0.25 wt.% in sulphur content in order to permit the insulating oil containing the refined oil (I), the refined oil (II) and, if desired, (III) the amorphous ethylene-propylene copolymer to keep its corrosion resistance (copper blackening resistance) securely satisfactory.

It has also been found by the inventors that the refined oil (I) should be limited to more than 25 wt.% in content of aromatic compounds to keep at a satisfactory level its hydrogen gas absorbency which may be an indicator of corrona resistance, and that it should be limited to not more than 35 wt.% to keep its thermal stability excellent.

The catalysts which may be used in the hydrofining according to this invention include the oxides of metals of Group VI, Group IB and Group VIII of the Periodic Table, the metal oxides being supported by bauxite, activated carbon, Fuller's earth, diatomaceous earth, zeolite, silica, silica alumina, alumina or the like, as the carrier. These catalyst are usually used after preliminary sulphurization of the catalytic metal portion on the carrier portion. Typical of the metal oxides are cobalt oxide, molybdenum oxide, tungsten oxide and nickel oxide.

In the practice of this invention there may particularly preferably be used a catalyst consisting of nickel and molybdenum oxides supported on an aluminum oxide-containing carrier, the metal oxides having been preliminarily sulphurized. The reaction temperatures in the hydrofining treatment may usually be in the range of about 230° - about 345° C, preferably 260° - 320° C. At lower reaction temperatures the reaction rate will be low, while at higher temperatures the oil to be treated wil be decomposed whereby the paraffin content is increased, the pour point is somewhat raised and the electrical insulating oil is not desirable in color. The reaction pressures may be at least 25 $Kg/cm^2G$, preferably 25 - 75 $Kg/cm^2G$ and more preferably 35 - 45

Kg/cm²G. In addition, the amounts of hydrogen contacted with the oil to be hydrofined may be 100 – 10,000 Nm³/Kl of oil, preferably 200 – 1,000 Nm³/Kl of oil.

The hydrofining method employed in this invention is one in which hydrogenolysis is very highly inhibited.

As mentioned above, the refined oil (I) which is one essential component of the insulating oil of this invention, is prepared by subjecting the starting mineral oil to the refinement with a solvent and the hydrofining whereby the starting oil is caused to contain aromatic compounds and sulphur each in a predetermined amount. As mentioned later, however, the omission of the refinement with the solvent will remarkably degrade thermal stability in electrical insulating oils being obtained, while the omission of the hydrofining will remarkably degrade oxidation stability, electrical properties, thermal stability and the like in electrical insulating oils being obtained.

The solvent dewaxing according to this invention is to solidify the waxy substance in the oil for removal therefrom by the use of a known method which is usually the BK method in this case. The solvents used herein include a mixed solvent such as benzene-toluene-acetone or benzene-toluene-methyl ethyl ketone. The suitable composition (ratio of ketonic component to aromatic components) of the solvent is about 30 – 35% for acetone-containing mixed solvents and about 45 – 50% for methyl ethyl ketone-containing ones.

The ratios of the solvent to the oil being dewaxed may be such that the solvent-added oil fed to a dewaxing filter is kept approximately constant in viscosity. The solvent dewaxing treatment according to this invention may be carried out at any stage, particularly preferably at a stage subsequent to the hydrofining step, in the process for the preparation of the electrical insulating oils. If necessary, the thus dewaxed oil may successively be treated with a solid adsorbent. The solid adsorbent treatment stated herein is intended to mean a treatment by which a mineral oil being treated is contacted with a solid adsorbent such as acid clay, activated clay, Fuller's earth alumina or silica alumina. The contact is usually effected at about 50° – 80° C for about a half hour to several hours. The contact method employed is a percolation, contact or like method.

The refined oil (II), which is a second essential component of the electrical insulating oil of this invention, is one prepared by treating at least with a solid adsorbent a lubricating oil fraction usually contained in a fraction having a boiling range of about 230° – 460° C at atmospheric pressure, the latter fraction being obtained by distilling various crude oils. The lubricating oil fraction may be contained in the fraction boiling at 230° – 460° C in the amounts of about 80 wt.%, preferably about 90 wt.%. In the solid adsorbent treatment effected in the preparation of the refined oil (II), there may be used the same operational conditions as used in the preparation of the refined oil (I). If the refined oil (II) is one which has been obtained without treatment with the solid adsorbent, the resulting insulating oil will be unsatisfactory in electric properties, color, thermal stability and the like.

In the preparation of the refined oil (II), there may be effected singly or jointly a solvent refining (refining with a solvent) treatment, a dewaxing treatment, a sulphuric acid refining (refining with sulphuric acid) treatment and the like, prior to the solid adsorbent treatment.

The operational conditions for these solvent refining and solvent dewaxing treatments are the same with those employed in the preparation of the refined oil (I); and the operational conditions for the sulphuric acid refining treatment used in preparing the refined oil (I) is identical with conventional ones used in the sulphuric acid refining treatment of ordinary mineral oils.

Since the amount of the refined oil (II) used is very small as compared with that of the refined oil (I) as mentioned later, such a sulphuric acid refining treatment will not result in the production of waste sulphuric acid in large amounts when the acid refining treatment is effected in the preparation of the refined oil (II); however, it is preferable to employ the aforementioned other refining means than said sulphuric acid refining means. The refined oil (II) may preferably contain about 0.1 – 2 wt.% of sulphur and more preferably contain about 0.2 – 1 wt.% of sulphur.

As previously mentioned, if the solid adsorbent treatment is to be effected in the preparation of each of the refined oils (I) and (II), the dewaxed hydrofined raffinate for the oil (I) and the lubricating oil fraction for the oil (II) may simultaneously be subjected to said treatment after these materials have been mixed together. Furthermore, the material for the oil (I), that for the oil (II) and the amorphous ethylene-propylene copolymer (III) may also simultaneously be subjected to the solid adsorbent treatment after these materials (I), (II) and (III) have been mixed together.

In one embodiment of this invention, 80 – 99 parts by weight of the refined oil (I) and 1 – 20 parts by weight of the refined oil (II) are blended together to obtain a new electrical insulating oil having a total sulphur content of not more than 0.35% by weight.

The use of less than 1 part by weight of the refined oil (II) as one of the essential components will result in the production of an electrical insulating oil which is satisfactory in corrosion resistance, corona resistance and thermal stability but unsatisfactory in oxidation stability, while the use of more than 20 parts by weight of the refined oil (II) will result in producing an electrical insulating oil which is inferior in corrosion resistance and thermal stability.

As mentioned above, the refined oils (I) and (II) may be blended together in specific suitable ratios by weight thereby to obtain desired electrical insulating oils which are satisfactory in all of oxidation stability, corrosion resistance, corona resistance and thermal stability.

The refined oil (II) may preferably be used in amounts of 3 – 10 parts by weight.

In addition, it is required according to this invention that the total sulphur content of the refined oils (I) and (II) after mixed together should be 0.35 wt.% or less. If the total sulphur content were more than 0.35 wt.% then the resulting electrical insulating oil would be degraded in corrosion resistance (copper blackening resistance) and would not be suitable for effective practical use. It is preferable that the sulphur content of the electrical insulating oils of this invention be in the range of from about 0.05 to 0.3 wt.%.

In another embodiment of this invention, the aforementioned mixture containing the refined oils (I) and (II) may be mixed with the essentially amorphous ethylene-propylene copolymer (III) as the third component thereby to obtain desired electrical insulating oils which are excellent not only in oxidation stability, thermal stability, corona resistance and corrosion resistance but also in low-temperature properties. It is economically disadvantageous to carry out the solvent dewaxing treatment to such an extent as to produce the refined oil (I) having a pour point of lower than about −27.5° C. In addition, the addition of the refined oil (II) to the refined oil (I) will hardly improve the resulting mixed oil in pour point. Said mixed oil may be lowered in pour point to as low as about −27.5° C more easily and at a lower cost by the addition thereto of the essentially amorphous ethylene-propylene copolymer as the third component, and, if desired, it may be further lowered in pour point to a temperature of as low as not higher than −40° C, the temperature being unable to be realized by an economically acceptable use of the ordinary solvent dewaxing treatment, thereby obtaining a three-component electrical insulating oil having a very low pour point of −40° C or lower of this invention.

The pour point depressants which have heretofore been extensively used in the preparation of lubricating oils, are mostly polymethacrylates. However, these depressants when used in the lubricating oil will, as an advantageous effect, depress it in pour point and will, as disadvantageous side effects, degrade it in water separability, emulsification resistance and electrical properties. They particularly when used in an electrical insulating oil will remarkably degrade it in emulsification resistance, this rendering them unsuitable as a pour point depressant therefor.

The essentially amorphous ethylene-propylene copolymers according to this invention may be added to a mixed oil containing 80 – 99 parts by weight of the refined oil (I) and 1 – 20 parts by weight of the refined oil (II), in amounts of 0.001 – 1.0, preferably 0.01 – 0.2 parts by weight per 100 parts by weight of the mixed oil; when so added to the mixed oil they will not have thereon any disadvantageous side effects such as increased emulsifiability, degraded electrical properties, decreased oxidation stability and decreased thermal stability. Unlike conventional pour point-lowering agents, the copolymers according to this invention are featured by the fact that they have no said effects, this feature being indispensable for electrical insulating oils.

The amorphous ethylene-propylene copolymer is an oil-soluble one having a weight average molecular weight of 10,000 – 200,000, preferably 20,000 – 70,000 and a propylene content of 10 – 70 mol%, preferably 20 – 60 mol%. The term "amorphous copolymer" used herein is intended to mean an amorphous copolymer which has some degree of crystallization, usually 0 – 5% and preferably 0 – 2% of crystallization. Furthermore, the amorphous copolymer should preferably be one having such a relatively narrow distribution of molecular weight as usually not more than 8, particularly preferably not more than 4.

The ethylene-propylene copolymers according to this invention may be prepared by specific known processes. The polymerization for the preparation of the copolymers may be effected by introducing ethylene, propylene and hydrogen gas into a catalyst composition at temperatures ranging from a low temperature to a somewhat elevated temperature (usually about −50° to 50° C) and at pressures ranging from atmospheric pressure to a somewhat pressurized atmosphere (usually about 1 to 20 Kg/cm$^2$ Absolute), the catalyst composition being obtained by mixing a specific homogenizable, organic solvent-soluble Ziegler-Natta type catalyst with an inert organic solvent. Ethylene and propylene are different in polymerizing reaction rate from each other, and the reaction rate of ethylene is much higher than that of propylene; because of this, the monomeric ratio between ethylene and propylene used does not agree with that between the two contained in the resulting copolymer. It is therefore necessary to pay a careful attention to the monomeric ratio of ethylene to propylene used in order to obtain an ethylene-propylene copolymer having a desired propylene content.

The homogenizable Ziegler-Natta type catalysts which may preferably be used in the preparation of the specific copolymer according to this invention, include coordination catalysts consisting of both a Vanadium compound represented by the general formula $VO(OR)_nX_{3-n}$ wherein X is chlorine, bromine or iodine, R is a residue of hydrocarbons having 1 – 6 carbon atoms and $n$ is an integer of 0 – 3, and an organoaluminum halide represented by the general formula $R_1R_2AlX_2$ or $R_1R_2R_3Al_2X_3$ wherein $R_1$, $R_2$ and $R_3$ are a residue of hydrocarbons having 1 – 20 carbon atoms and may be different from, or identical with, each other. Typical of the organoalumimum halides are diethyl aluminum chloride, diisopropyl aluminum chloride and ethyl aluminum dichloride. The inert organic solvents usually used in the copolymerization include aliphatic and aromatic hydrocarbons with n-hexane, heptane, toluene, xylene and the like being preferred.

As mentioned above, it has been found by the present inventors as a result of their intensive studies of refining conditions for mineral oils derived from paraffin or mixed base crude oils, that the refined oil (I) containing not more than 0.25 wt. % of sulphur and from more than 25 wt. % to not more than 35 wt. % of aromatic compounds may be produced reliably and reproducibly by the use of a conventional apparatus and the thus produced refined oil (I) may then be blended with the refined oil (II) in such ratios that the resulting blended oil has a total sulphur content of not more than 0.35 wt. % thereby to obtain an electrical insulating oil of this invention having excellent oxidation stability, thermal stability, corona resistance and corrosion resistance, and that said blended or two-component oil may further be blended with a specific small amount of the amorphous ethylene-propylene copolymer thereby to obtain an electrical insulating oil of this invention which is excellent in low-temperature performances without impairing said other excellent properties.

This invention will be better understood by the following non-limitative examples for illustration purpose only, in which examples all parts and percentages are by weight unless otherwise specified.

EXAMPLE 1

There was obtained a distillate (boiling range of 250° – 400° C at atmospheric pressure, sulphur content of 2.0 wt. % and aromatic content of 41 wt. %) by distilling a Middle East-produced (mixed base) crude oil at atmospheric pressure to recover a bottom oil and then distilling the bottom oil so recovered at a reduced pressure. The distillate so obtained was extracted with furfural in the ratio by volume of 1.2 between furfural and distillate at a temperature of 75° – 95° C to obtain a raffinate which is then hydrofined in the presence of an $NiO$-$MoO_3$ catalyst ($NiO$:3.0 wt. %; $MoO_3$:14.0 wt. %) carried on alumina, at a temperature of 320° C and a hydrogen pressure of 40 Kg/cm$^2$G and at a liquid hourly space velocity (LHSV) of 1.0. The raffinate so hydrofined was dewaxed with a benzene-toluene-methyl ethyl ketone solvent in the solvent ratio of 1.6 between the solvent and the hydrofined raffinate and at a cooling temperature of −30° C and was then treated with clay at 70° C for 1 hour, thereby obtaining a refined oil (I)

having a pour point of −27.5° C, sulphur content of 0.05 wt. % and aromatic content of 28 wt. %. The refined oil (I) so obtained was measured for its acid value by the use of an oxidation stability test prescribed in JIS (Japanese Industrial Standard) C 2101 with the result that its acid value was found to be 1.9 mg KOH/g.

The aforementioned distillate obtained by the distillation at the reduced pressure was likewise extracted with furfural in the solvent ratio of 1.6 between the solvent and the distillate used, thereby producing a raffinate which was subjected to the same solvent dewaxing and clay treatments as in the preparation of the refined oil (I) whereby a refined oil (II) of this invention having a sulphur content of 0.7 wt. % and aromatic content of 21 wt. %. There were blended together 95 parts by weight of the thus obtained refined oil (I) and 5 parts by weight of the thus obtained refined oil (II) to obtain an electrical insulating oil of this invention having an acid value of 0.32mgKOH/g as determined by the JIS oxidation stability test, and a pour point of −27.5° C.

Three hundred milliliters of the electrical insulating oil so obtained were introduced into a 500-ml glass vessel in which copper electrodes were provided 2 mm apart from each other, and a current application test was conducted at an application of 10 KV to the electrodes and at 100° C in a nitrogen atmosphere for 10 days with the result that the amount of sulphur deposited on the electrodes was found to be only 3.5 μg. Furthermore the electrical insulating oil obtained in this Example was tested for its hydrogen gas absorbency which is an indicator of corona resistance, by the method (based on the "Technical report No. 6, the Research Committee of Electrical Insulating Oils of Japan") with a satisfactory result that [(a value after 150 minutes) − (a value obtained after 50 minutes)] was −45 mm Oil.

This insulating oil after subjected to a heating test (ASTM D 1934, no catalyst), had a satisfactory dielectric loss tangent of 0.30 % (80° C) and volume resistivity of $2.6 \times 10^{13}$ Ω-cm (80° C).

EXAMPLES 2 - 9 AND COMPARATIVE 1 - 5

A bottom oil obtained by distilling Middle-East produced (mixed base) crude oil at atmospheric pressure, was distilled at a reduced pressure of about 40 mmHg to obtain a distillate boiling at 255° - 405° C at atmospheric pressure and having a sulphur content of 2.2 wt. % and aromatic content of 42 wt. %. Portions of the distillate so obtained were subjected to solvent refining (extraction with furfural) and then hydrofining under the different operational conditions as shown in Table 1 and further subjected to solvent dewaxing and then clay treatment under the same conditions as Example 1 thereby to obtain desired refined oils (I)-1 to (I)-3 and comparative refined oils (I')-1 to (I')-2, respectively. Separately, portions of the aforesaid distillate were subjected to solvent refining (extraction with furfural) as required, solvent dewaxing as required and clay treatment under the conditions as shown in Table 1 thereby to obtain desired refined oils (II)-1 to (II)-4.

Then the refined oils thus obtained were blended together as shown in Table 2 to obtain desired electrical insulating oils (Examples 2–9) and comparative electrical insulating oils (Comparative example 1–5). Thus desired and comparative insulating oils were tested for their properties, and the results are shown in Table 2.

Table 2 indicates the following.

Comparative example 1 shows that the insulating oil containing the comparative refined oil (I')-1 prepared without the solvent refining (extraction) is an unsatisfactory one having a remarkably degraded thermal stability.

Comparative example 2 indicates that if the refined oil (I) is singly used as an electrical insulating oil then the insulating oil will not exhibit satisfactory oxidation stability, while Example 2 indicates that if the refined oil (I)-1 is used in admixture with the refined oil (II)-2 then the resulting mixed oil will exhibit remarkably improved oxidation stability as an electrical insulating oil.

Examples 4 - 6 indicate the variation in effects or properties of the product insulating oil with varying amounts of the refined oil (II)-2 added to the refined oil (I)-3, while Comparative example 3 indicates that if too much of the refined oil (II)-2 is added to the refined oil (I)-3 then the resulting insulating oil will be an unsatisfactory one having no further improved oxidation stability and degraded thermal stability.

Examples 7 - 8 clarify that there may also be used as the refined oil (II) according to this invention the refined oil (II)-3 (Example 7) prepared only by clay treatment without solvent refining (extraction) treatment and the refined oil (II)-4 (Example 8) prepared by subjecting the lubricating oil fraction of naphthene type to solvent refining.

Comparative example 4 indicates that the product insulating oil containing sulphur in amounts of more than 0.35 wt. % has degraded corrosion resistance and thermal stability.

Comparative example 5 indicates that if the refined oil (I')-2 having an aromatic content of less than 25 wt. % is mixed with the refined oil (II)-2 then the resulting insulating oil will be an unsatisfactory one which is inferior in hydrogen gas absorbency.

Table 1

| | Properties of Refined Oils (I) and (II) | | | | | | | | Properties of refined oil | |
|---|---|---|---|---|---|---|---|---|---|---|
| | Solvent refining | | Hydrofining | | | | | | | |
| | Solvent/Oil Ratio (furfural/oil) | Extracting temp. (° C) | Catalyst | Reaction temp. (° C) | Hydrogen pressure (kg/cm²G) | LHSV | Dewaxing | Clay treatment | Sulphur content (wt.%) | Aromatic content (wt.%) |
| Desired refined oil (I)-1 | 0.5 | 75–95 | NiO—$MoO_3$ type | 340 | 40 | 0.5 | Dewaxing | Clay treatment | 0.16 | 33 |
| (I)-2 | 1.0 | " | " | 320 | " | 1.5 | " | " | 0.19 | 30 |
| (I)-3 | 1.2 | " | " | " | " | 1.0 | " | " | 0.04 | 27 |
| Comparative refined oil (I')-1 | None | None | " | 360 | " | 0.5 | " | " | 0.25 | 38 |
| (I')-2 | 1.5 | 75–95 | " | 315 | " | 1.5 | " | " | 0.08 | 22 |
| Desired refined oil (II)-1 | 0.8 | 75–95 | None | None | | | " | " | 1.40 | — |

Table 1-continued

| | Properties of Refined Oils (I) and (II) | | | | | | | | | |
|---|---|---|---|---|---|---|---|---|---|---|
| | Solvent refining | | Hydrofining | | | | | | Properties of refined oil | |
| | Solvent/Oil Ratio (furfural/oil) | Extracting temp. (° C) | Catalyst | Reaction temp. (° C) | Hydrogen pressure (kg/cm²G) | LHSV | Dewaxing | Clay treatment | Sulphur content (wt.%) | Aromatic content (wt.%) |
| (II)-2 | 1.6 | " | " | " | | | " | " | 0.70 | — |
| (II)-3 | None | None | " | " | | | " | " | 1.95 | — |
| (II)-4*[1] | 2.0 | 60–90 | " | " | | | None | " | 0.81 | — |

*[1]The same refining procedure as that for the Middle-East produced crude oil was followed except that there was used as the starting oil a lubricating oil fraction boiling at 265° – 430° C obtained by distilling a Tia Juana (naphthene base) crude oil at atmospheric pressure.

Table 2

| | Compositions and Properties of Electrical Insulating Oils | | | | | | | | |
|---|---|---|---|---|---|---|---|---|---|
| | | | Properties of insulating oils | | | | | | |
| Examples and Comparative examples | Composition of insulating oil: Refined oil (I) (wt.%) | Composition of insulating oil: Refined oil (II) (wt.%) | Sulphur (wt.%) | Oxidation stability (JISC2101): acid number mgKOH/g | Oxidation stability (JISC2101): Sludge % | Hydrogen gas absorbency [Value for 150 min.]-[Value for 50 min.] min Oil | Current application test: Mount of sulpher deposited on copper test piece (μg) | Thermal stability (ASTMD1934 No catalyst): Dielectric loss tangent (80° C,%) | Thermal stability (ASTMD1934 No catalyst): Volume resistivity (×10¹²) 80° C, Ω·cm |
| Comparative example 1 | (I')-1 95 | (II)-2 5 | 0.27 | 0.47 | 0.16 | — | — | 1.75 | 0.9 |
| Comparative example 2 | (I)-2 100 | (II)-2 0 | 0.16 | 1.25 | 0.29 | — | — | — | — |
| Example 2 | (I)-2 95 | (II)-2 5 | 0.18 | 0.35 | 0.14 | −60 | 5.1 | 0.77 | 8.5 |
| Example 3 | (I)-2 95 | (II)-2 5 | 0.22 | 0.31 | 0.12 | −49 | 4.9 | 0.60 | 12.0 |
| Example 4 | (I)-3 97 | (II)-2 3 | 0.06 | 0.37 | 0.14 | −41 | 3.9 | 0.25 | 35.0 |
| Example 5 | (I)-3 95 | (II)-2 5 | 0.07 | 0.26 | 0.12 | −35 | 3.5 | 0.38 | 28.0 |
| Example 6 | (I)-3 85 | (II)-2 15 | 0.14 | 0.25 | 0.10 | −37 | 4.1 | 0.45 | 9.5 |
| Comparative example 3 | (I)-3 75 | (II)-2 25 | 0.20 | 0.30 | 0.14 | — | 7.5 | 1.34 | 3.1 |
| Example 7 | (I)-3 95 | (II)-3 5 | 0.14 | 0.28 | 0.13 | −39 | 6.5 | 0.67 | 15.0 |
| Example 8 | (I)-3 90 | (II)-4 10 | 0.12 | 0.26 | 0.12 | −42 | 4.9 | 0.60 | 17.0 |
| Example 9 | (I)-2 90 | (II)-1 10 | 0.31 | 0.32 | 0.13 | — | 6.8 | 0.71 | 10.0 |
| Comparative example 4 | (I)-2 85 | (II)-1 15 | 0.37 | 0.35 | 0.16 | — | 13.4 | 1.25 | 2.3 |
| Comparative example 5 | (I')-2 95 | (II)-2 5 | 0.11 | 0.33 | 0.11 | + 3 | — | — | — |

EXAMPLE 10

The electrical insulating oil obtained in Example 1 was incorporated with an amorphous ethylene-propylene copolymer having a weight average molecular weight of 40,000 and a propylene content of 37.5 mol %, in the amount of 0.1 part by weight per 100 parts by weight of electrical insulating oil. The copolymer-added insulating oil had a pour point of −42.5° C which was remarkably lower than that of the original electrical insulating oil. The copolymer-added insulating oil was tested for oxidation stability, corrosion resistance under the application of an electric current, corona resistance and thermal stability, with the result that these properties found by the test were satisfactory ones which were quite the same as those of the original insulating oil.

EXAMPLE 11 AND COMPARATIVE EXAMPLE 6

A bottom oil obtained by distilling a Middle-East produced (mixed base) crude oil at atmospheric pressure was distilled at a reduced pressure thereby to obtain a distillate boiling at 275°– 380° C and having a sulphur content of 2.3 wt. % and an aromatic content of 39 wt. %. The distillate so obtained was treated in the same manner as in Example 1 except that it was dewaxed at a cooling temperature of −25° C, whereby is obtained a refined oil (I) having a pour point of −22.5° C, a sulphur content of 0.09 wt. %, an aromatic content of 27 wt. % and an acid value of 1.4 mgKOH/g as determined by the oxidation stability test. Ninety-five parts by weight of the refined oil (I) so obtained were incorporated with 5 parts by weight of the refined oil (II) obtained in Example 1 to obtain an electrical insulating oil A. The insulating oil A was blended with an amorphous ethylene-propylene copolymer having a weight average molecular weight of 28,000 and a propylene content of 52.5 mol %, in the amount of 0.2 parts by weight per 100 parts by weight of insulating oil A whereby an insulating oil B was obtained. The properties of the insulating oil A and the insulating oil B are shown in Table 3. Table 3 also shows the properties of another insulating oil C (Comparative example 6) prepared by adding a commercially available polymethacrylate to the insulating oil A in the amount of 0.3 parts by weight per 100 parts by weight of the insulating oil A. It is seen from Table 3 that the insulating oil C is improved in pour point but degraded in emulsification resistance, electrical properties and thermal stability as compared with the insulating oil A, thereby rendering the insulating oil C (Comparative example 6) unsuitable or impossible to use as an electrical insulating oil; on the other hand, the insulating oil A will be improved in pour point without degrading any properties thereof by adding thereto the amorphous ethylene-propylene copolymer, thereby rendering the insulating oil B (Example 11) very suitable to use as an electrical insulating oil.

Table 3

| | Insulating oil A | Insulating oil B (Ex. II) | Insulating oil C (Comparative example 6) |
|---|---|---|---|
| Pour point (° C) | −22.5 | −32.5 | −32.5 |
| JIS Oxidation stability | | | |
| Sludge (%) | 0.12 | 0.12 | 0.15 |
| Acid number (mgKOH/g) | 0.28 | 0.29 | 0.35 |
| Steam emulsion number | 35 | 31 | 1200 |
| Volume resistivity (80° C Ω·cm/ | $4.5\times10^{15}$ | $3.8\times10^{15}$ | $7.7\times10^{14}$ |
| Volume resistivity (80° C Ω·cm) after thermal test (ASTM D 1934, no catalyst) | $4.8\times10^{13}$ | $5.3\times10^{13}$ | $6.5\times10^{12}$ |
| Amount of sulphur deposited on copper plate in test under current application | 4.1 | 3.8 | — |
| Hydrogen gas absorbency [Value for 150 min.]-[Value for 50 min.] mm Oil | −43 | −41 | — |

What is claimed is:

1. An electrical insulating oil consisting essentially of (A) 80 – 99 parts by weight of a refined oil (I) containing not more than 0.25 wt. % of sulphur and more than 25 wt. % to not more than 35 wt. % of aromatic compounds, the refined oil being produced by the steps of:

refining with a solvent capable of selectively dissolving aromatic compounds a distillate contained in a fraction having a boiling range of 230° – 430° C at atmospheric pressure obtained by the distillation of a paraffin or mixed base crude oil at atmospheric pressure or the distillation at a reduced pressure of a bottom oil obtained by the distillation of the crude oil at atmospheric pressure thereby to obtain a raffinate from said distillate, hydrofining the raffinate so obtained and dewaxing the thus hydrofined raffinate with a solvent (B) 1 – 20 parts by weight of an unhydrofined refined oil (II) prepared by treating at least with a solid adsorbent a lubricating oil fraction of a mineral oil having a boiling range of 230° – 460° C at atmospheric pressure obtained from a crude oil thereby to obtain a base oil for the electrical insulating oil, the base oil having a total sulphur content of not more than 0.35 wt. %, and (C) 0.001 – 1.0 part by weight per 100 parts by weight of said base oil, of an essentially amorphous ethylene-propylene copolymer (III) having a weight average molecular weight of 10,000 – 200,000 and a propylene content of 10 – 70 mol %, whereby is obtained the electrical insulating oil having a low pour point as well as excellent oxidation stability, thermal stability, corona resistance and corrosion resistance.

2. An electrical insulating oil according to claim 1, wherein the solvent capable of selectively dissolving aromatic compounds is a member selected from the group consisting of furfural, liquefied sulphur dioxide and phenol.

3. An electrical insulating oil according to claim 1, wherein the hydrofining is effected at temperatures of about 230° – about 345° C and pressures of at least 25 Kg/cm²G in the presence of a catalyst selected from the group consisting of the oxides of metals of Groups VI, IB, and VIII, the catalyst being usually sulphurized prior to its use and supported on a carrier selected from the group consisting of bauxite, activated carbon, Fuller's earth, diatomaceous earth, zeolite, alumina, silica and silica alumina.

4. An electrical insulating oil according to claim 1, wherein the solvent for dewaxing is a member selected from the group consisting of a benzene-toluene-acetone mixed solvent and a benzene-toluene-methyl ethyl ketone mixed solvent.

5. An electrical insulating oil according to claim 1, wherein the amorphous ethylene-propylene copolymer is one prepared by introducing ethylene, propylene and hydrogen gases through a homogenizable Ziegler-Natta type catalyst at temperatures usually from about −50° to about 50° C and pressures usually from about 1 to about 20 Kg/cm² Absolute.

6. An electrical insulating oil according to claim 1, wherein the dewaxed hydrofined raffinate is further treated with a solid adsorbent.

* * * * *